US005456963A

United States Patent [19]

Bettanny

[11] Patent Number: 5,456,963

[45] Date of Patent: Oct. 10, 1995

[54] HAIR GRIPPING END PAPERS FOR PERMANENT WAVING AND METHOD FOR MANUFACTURING SAME

[75] Inventor: Jean M. Bettanny, Westmont, Ill.

[73] Assignee: Eclipse Hair Design, Clarendon Hills, Ill.

[21] Appl. No.: 171,522

[22] Filed: Dec. 22, 1993

[51] Int. Cl.[6] ..... A45D 6/00

[52] U.S. Cl. ..... 428/100; 132/202; 132/210; 428/192; 428/220; 428/507; 428/511; 428/512

[58] Field of Search ..... 428/100, 99, 192, 428/194, 220, 507, 511, 512; 132/202, 210

[56] References Cited

U.S. PATENT DOCUMENTS 3,134,834 5/1964 Tobias ..... 428/511
3,266,841 8/1966 Altman ..... 428/100
3,619,816 11/1971 Cowen ..... 428/511
4,968,548 11/1990 Gibson ..... 428/100

OTHER PUBLICATIONS

Matrix Essentials, Clearlites Highlighting Transparencies product advertisement (1993).
Cameo Beauty Supply Catalog 1992–1993, p. 109.
P. 38 of Cameo Beauty Supply Catalog 1992–1993.

*Primary Examiner*—Nasser Ahmad
*Attorney, Agent, or Firm*—Banner & Allegretti, Ltd.

[57] ABSTRACT

An end paper for permanent waving of hair has a gripping strip of hook-type projections applied to the edge of the end paper. The gripping strip allows for the perming of short coarse hair, and the use of larger rollers than otherwise could be used for short hair. The gripping strip is sewn or affixed onto the end paper.

9 Claims, 1 Drawing Sheet

Fig. 1
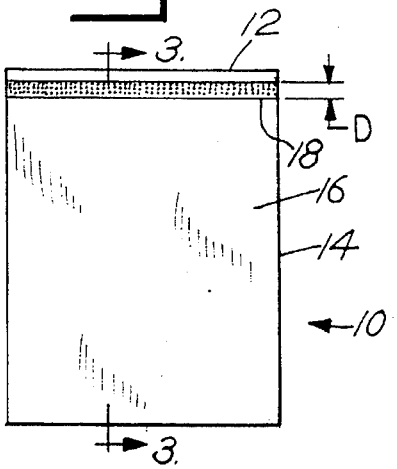
Fig. 2
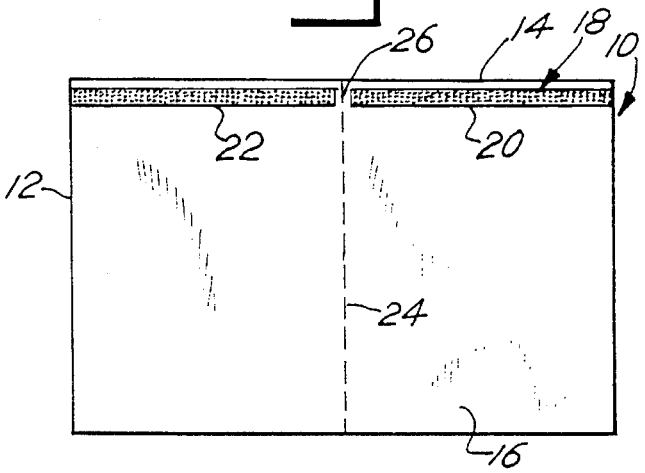
Fig. 3
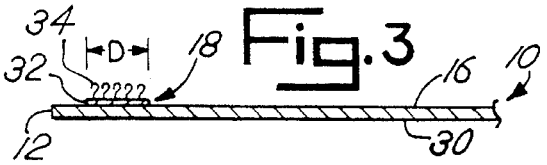
Fig. 4
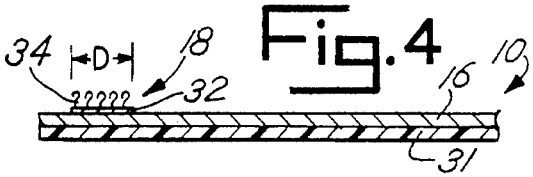
Fig. 5
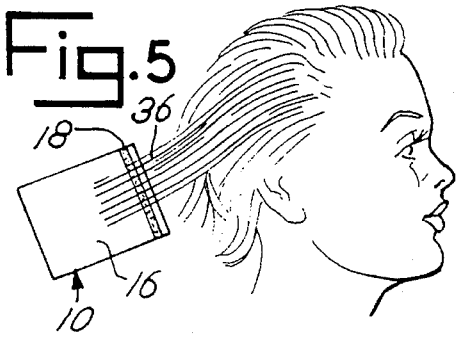
Fig. 7
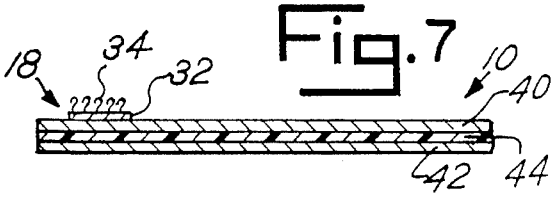
Fig. 8
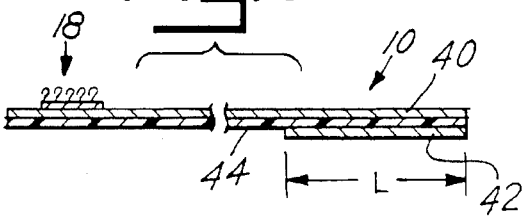
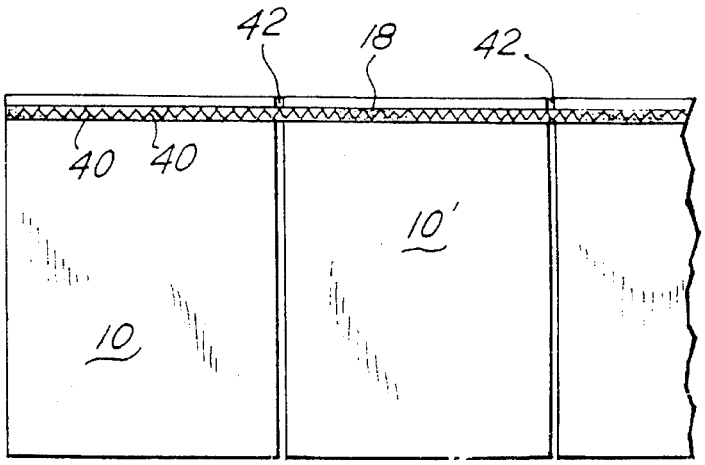
Fig. 6

HAIR GRIPPING END PAPERS FOR PERMANENT WAVING AND METHOD FOR MANUFACTURING SAME

BACKGROUND OF THE INVENTION

A. Field of the Invention

This invention relates to the field of hairdressing, and more particularly to the art of permanent waving hair.

B. Description of Related Art

In contemporary hair salons, hair is given a permanent wave by first placing the ends of clean, wet hair between a pair of end papers, then wrapping the hair and end papers around a rod, applying a permanent waving solution to the hair while the hair is in a rolled condition, and finally letting the hair process until the hair has broken down sufficiently to accept a neutralizing solution that locks the new curl pattern into the hair.

A widely recognized, but heretofore unsolved problem in the art, has been finding a way to keep permanent rods from falling out of the hair in certain recurring situations, such as when very short (under 3 inches in length) coarse hair is being rolled, and when a relatively large rod is being used for short hair. In these circumstances, the permanent rod slides out of the roll of hair very easily due to the weight of the rod and the hair, due to forces applied to the hair and rod when the hair is being rinsed, and due to jostling of the hair and rollers when the client moves his or her head.

VELCRO™-type materials have been used in the prior art to facilitate gripping of hair, but its applicability to the above-described problem has not been recognized. One example is VELCRO™-type rollers, which comprise a hollow cylindrical body with hook projections on the exterior surface thereof. These rollers have been used for setting hair, but are generally not used for perming hair. Should such rollers be used with end papers for perming hair, the end papers would prevent the hair encased therebetween from being gripped by the hook projections. Hence, these rollers provide no enhanced gripping for perming hair when used with end papers. However, the present invention can be used with the VELCRO™ rollers to provide improved gripping of the hair in the permanent waving process.

VELCRO™-type gripping strips are found on the prior art CLEAR LITES plastic highlighting transparencies from Matrix Essentials, Inc. These plastic sheets are used in the coloring and highlighting of hair. The CLEAR LITES have a strip of hook projections adjacent to the top edge of the plastic sheet. In use, the hook projections are pressed into the scalp at the hair parting, for the purpose of making a seal between the plastic sheet and the scalp to thereby prevent color seepage onto the hair which is not to be colored. The CLEAR LITES product is useless for permanent waving since the slippery plastic sheets would not hold hair during the winding of the hair on a rod. Moreover, the plastic is not porous and is too thick and bulky to be wound around a rod.

The above described prior art techniques are ineffective for solving the permanent waving problem of gripping short hair on a permanent waving rod. Heretofore, the perming of short, coarse hair, or using large permanent rods on short hair, has been problematical. The present invention solves this problem in an unexpected way and permits larger rods than could otherwise be used in straight, coarse hair. The invention satisfies a long felt need in the art, and solves a problem that others have been unsuccessful in solving. In the past, the perming of short hair has been accomplished only by using very small-diameter rods, resulting in overly-curly hair.

SUMMARY OF THE INVENTION

The present invention is an apparatus for permanent waving hair comprising a permanent waving end paper having a top surface and a bottom surface, the top surface having a first edge and an adjacent second edge, the length of the first edge being less than or equal to the length of the second edge. The end paper encases the ends of the hair to permit the hair to be rolled onto a permanent waving rod. A gripping strip is affixed to the top surface of the end paper adjacent to either the first edge or the second edge for gripping the hair placed perpendicularly across the strip. In the preferred embodiment, the gripping strip comprises a strip of hook-type projections of between ½ and 1/16 inches in width. The invention can be used with different types of end papers, such as regular end papers and end papers which are used for root perms. Various methods for manufacturing the end papers are also described.

An object of the invention is to provide an end paper construction which permits short, coarse hair to be wrapped around relatively large perming rods.

Another object of the invention is to provide a method for manufacturing the end papers having the gripping strip applied to one edge of the paper.

BRIEF DESCRIPTION OF THE DRAWINGS

In the following detailed description of the preferred embodiment, reference will be made to the appended drawings, wherein like reference numerals refer to like elements in the various views, and wherein FIG. 1 is a plan view of a permanent waving end paper having a gripping strip applied to the edge thereof in accordance with the invention;

FIG. 2 is a plan view of an alternative embodiment of the end paper and gripping strip of FIG. 1;

FIG. 3 is a cross-sectional view of the end paper of FIG. 1 along the line 3—3;

FIG. 4 is a cross-sectional view of an alternative embodiment of the end paper and gripping strip of FIG. 1;

FIG. 5 is an illustration of the usage of the end paper of FIG. 1 with strands of hair;

FIG. 6 in an illustration of a preferred technique for manufacturing the end paper construction of FIG. 1;

FIG. 7 is a cross-sectional view of an alternative construction of the end paper of FIG. 1; and FIG. 8 is an alternative construction of the end paper of FIG. 7.

DETAILED DESCRIPTION OF THE PREFERRED EMBODIMENT

Referring to FIG. 1, a generally rectangularly shaped permanent waving end paper 10 has a first or top edge 12 and an adjacent second edge 14. The length of the top edge 12 is typically less than the edge of the second edge 14. The end paper comprising a sheet of light-weight, fine, porous paper has a top surface 16 and a bottom surface 30 (FIG. 3).

Disposed adjacent to the top edge 12 is a gripping strip 18 for gripping hair that is laid across the strip 18 during the rolling of the hair. The strip 18 preferably comprises hook-type fastening projections such as the hook component of VELCRO™. The pile component of VELCRO™ has been found not to work satisfactorily. Preferably, the width D of the strip 18 is between ½ inch and 1/16 inches. A width of 3/16 to ¼ inch is preferred. It has been found that for widths greater than ½ inch, the paper 10 tends to become too bulky for rolling the hair, while widths of less than 1/16 inch usually do not have enough surface area to be effective to grip the hair lying perpendicular to the strip 18.

Referring now to FIG. 2, some stylists prefer to use the "book end wrap" technique for wrapping perms. The invention may be used in this technique, and the construction of FIG. 2 is particularly suitable. The paper 10 has a gripping strip 18 in the form of two discrete hook-type VELCRO™ strips 20 and 22 which are affixed to the end paper 10 adjacent to the second edge 14 of the end paper 10. The center line 24 of the end paper is a line about which the two halves of the paper are folded. The strips 20 and 22 are positioned such that a small gap 26 separates the two strips 20 and 22. The gap may simply be a cut separating the strips or a small gap on the order of 1/16 inch in the vicinity of the center line 24. With this construction, the paper 10 can be folded without undue bulkiness in the vicinity of the center line 24.

Referring now to FIG. 3, the end paper and gripping strip of FIG. 1 is shown in a cross-sectional view. The end paper 10 of FIG. 3 comprises a permanent waving end paper made of paper. The strip 18 has a base portion 32 of width D which is affixed to the end paper 10 adjacent to the first edge 12. Hook-type projections 34 project upwardly from the top surface 16 of the end paper.

Referring now to FIG. 4, the permanent waving end paper 10 may alternatively comprise a plastic coated end paper having a top paper layer 16 to which is applied a bottom plastic coating layer 31. This construction is particularly suitable for perming of the roots of hair. Once wrapped around the hair, the plastic coating layer 31 prevents permanent waving solution from contacting the hair within the paper layer 16, preventing the wrapped hair from damage due to over processing of the hair. The end paper 10 of FIG. 4 also has the gripping strip 18 comprising base portion 32 affixed to the paper layer 16 and hook projections 34 projecting upwardly above the end paper 10.

Referring now to FIG. 5, the usage of the end paper and gripping strip according to the invention is now described. If the stylist is having difficulty getting the hair to grip the rods, as is typically the case when very short hair is being rolled, the stylist will use the end papers as described herein. The hair strands 36 are laid over the end paper 10 such that the strands 36 lie directly across the gripping strip 18 and the top surface of the end paper 10. The paper 10 is positioned such that the ends of the hair 36 lie over the top surface 16 of the paper 10 as shown in FIG. 5. The stylist then places a second end paper (not shown) according to the present invention over the end paper 10 such that the top surface of the second end paper (and gripping strip) is facing downward, sandwiching the hair 36 in between the two end papers 10. The gripping strips 18 need not be placed directly over one another. The stylist then rolls the two end papers 10 and hair 36 over a hair rod in conventional fashion.

The preferred method of making the end papers 10 of the present invention is shown in FIG. 6. A long gripping strip 18 is first prepared by cutting a standard one inch VELCRO™ hook strip into four long ¼ inch strips. The strips 18 are sewn onto the end papers 10 using large zig-zag stitches 40 by a sewing machine. Once end paper 10 has been sewn to the strip 18, another end paper 10' is fed into the sewing machine and the strip 18 is sewn onto the end paper 10'. The process is then repeated for each successive end paper. The end papers are separated from each other by trimming the strips 18 at the breaks 42 between the adjacent end papers. The sewing construction of FIG. 6 results is a very sturdy end paper that is even capable of repeated use after rinsing and drying. The reuseability of the end papers reduces the cost per use of the end papers. Mass production of the end papers may be accomplished by sewing a long strip of hook projections onto large sheets of the end papers, and then trimming the sheets to individual end papers 10.

An alternative, but less favored, method of making the invention is to adhere the hook projections to the end papers. The adhesives must be capable of withstanding harsh perm solutions and other chemicals, and vigorous washing and handling, lest the hook projections become separated from the end papers.

Referring now to FIG. 7, an alternative construction of an end paper suitable for root-perming is shown. The end paper 10 is a three-layer end paper which gives improved gripping characteristics to the end paper 10. Whereas prior art end papers for root perming have a top paper layer and a bottom plastic layer, like that shown in FIG. 4, the plastic layer tends to be slippery. In my invention, the top and bottom layers 40 and 42, respectively, are made from paper, while the middle layer 44 is made from plastic. The paper layers 40 and 42 grip the permanent waving rod more easily, while the plastic layer 44 provides a barrier to the entry of permanent solutions to the hair rolled within the end paper 10. The end paper construction is suitable for use with or without the gripping strip 18 of FIGS. 1–6. An alternative to the embodiment of FIG. 7 is shown in FIG. 8 and has a paper strip 42 only along a portion of the bottom surface of the end paper 10. The paper strip has a length L of preferably ½ inch to 2 inches, thereby reducing the bulkiness of the end paper 10. The embodiment of FIG. 8 may again have (or not have) a gripping strip 18 applied to the top surface of the end paper.

By virtue of the present invention, short hair which otherwise would be difficult or impossible to roll onto a rod can now be permed on a larger rod. The hook-type projections add excellent gripping characteristics to an end paper.

Various modifications and alterations may be made to the foregoing detailed description of preferred and alternative embodiments of the invention without departure from the true spirit and scope of the invention. For example, while the strips are preferably adjacent to the edges of the end papers, the gripping strips could be more centrally located on the end papers. This true spirit and scope of the invention is described in the appended claims, to be interpreted in light of the foregoing specification.

I claim:

1. A hair gripping end paper for use with a permanent waving rod to apply a permanent wave to human hair comprising:

a permanent hair waving end paper having a top surface, said top surface having a first edge and an adjacent second edge, the length of said first edge being less than or equal to the length of said second edge, said end paper encasing the ends of said hair to permit said hair to be rolled onto said permanent waving rod; and a hair gripping hook projection strip having a width of between about 1/16th inch and about ½ inch applied to said top surface of said end paper adjacent to and extending alone said first edge for gripping said hair tightly about said rod when said hair and said end paper are wrapped around said rod.

2. The apparatus of claim 1, wherein said gripping hook projections is sewn onto said end paper.

3. The apparatus of claim 1, wherein said end paper further comprises a bottom surface and said end paper is adapted for use in root perming of said hair, said top surface of said end paper comprises a layer of paper, and wherein said bottom surface of said end paper comprises a plastic coating layer for blocking permanent waving solution from coming into contact with said hair.

4. A hair gripping end paper for use with a permanent waving rod to apply a permanent wave to human hair comprising:

a permanent hair waving end paper having a top surface, said top surface having a first edge and an adjacent second edge, said second edge having a length greater than the length of said first edge, said end paper encasing the ends of said hair to permit said hair to be rolled onto said permanent waving rod; and a hair gripping hook projection strip having a width of between about 1/16 inch and about 1/16 inch applied to said top surface of said end paper in an orientation parallel to and adjacent said second edge for gripping said hair tightly about said rod when said hair and said end paper are wrapped around said rod.

5. The apparatus of claim 4, wherein said gripping strip comprises first and second strips of hook projections affixed to said end paper, said first and second strips separated from one another at approximately the midpoint of said second edge.

6. The apparatus of claim 4, wherein said end paper further comprises a bottom surface and said end paper is adapted for use in root perming of said hair, said top surface of said end paper comprises a layer of paper, and wherein said bottom surface of said end paper comprises a plastic coating for blocking permanent waving solution from contact with said hair.

7. The apparatus of claim 4 wherein said gripping hook projections is sewn onto said end paper.

8. Hair dressing apparatus, comprising, in combination:

a permanent waving rod; and a permanent waving end paper for use with said permanent waving rod to apply a permanent wave to human hair, said permanent waving end paper comprising:

a thin top paper layer, a middle plastic layer and a bottom paper layer;

said top paper layer laminated to said middle plastic layer, said middle plastic layer having a bottom surface, said middle plastic layer for forming a barrier to the penetration of permanent waving solutions to hair that is rolled within said end paper, said bottom paper layer laminated to said bottom surface of said middle plastic layer, said bottom paper layer gripping said permanent waving rod when said hair and said end paper are wrapped around said rod, a hair gripping hook projection strip having a width of between about 1/16th inch and about ½ inch is applied to a top surface of said top paper layer and adjacent to and extending along a first edge of said top paper layer.

9. The end paper of claim 8 wherein said bottom paper layer laminated to said bottom surface of said middle plastic layer in a strip having a length L wherein said length L is between ½ and 2 inches.

* * * * *